United States Patent [19]

Chazard et al.

[11] 4,119,545

[45] Oct. 10, 1978

[54] CONCENTRATED FABRIC SOFTENING COMPOSITION

[75] Inventors: Georges Jean Paul Chazard, Bezons; Monique Seugnet, Colombes, both of France

[73] Assignee: Colgate Palmolive Company, New York, N.Y.

[21] Appl. No.: 777,993

[22] Filed: Mar. 28, 1977

[51] Int. Cl.[2] ..... D06M 13/46

[52] U.S. Cl. ..... 252/8.8; 252/358; 252/363.5

[58] Field of Search ..... 252/8.8, 8.6, 358, 363.5; 8/115.6

[56] References Cited

U.S. PATENT DOCUMENTS

| | | | |
|---|---|---|---|
| 2,717,842 | 9/1955 | Vitalis | 252/8.6 |
| 3,346,873 | 10/1967 | Herrmann | 252/363.5 |
| 3,440,171 | 4/1969 | Warren | 252/363.5 |
| 3,959,155 | 5/1976 | Montgomery et al. | 252/8.8 |

*Primary Examiner*—William E. Schulz

*Attorney, Agent, or Firm*—Norman Blumenkopf; Herbert S. Sylvester; Murray M. Grill

[57] ABSTRACT

A stable concentrated fabric softening composition comprises an anti-gelling agent, a cationic softening agent, and the remainder being substantially water.

8 Claims, No Drawings

CONCENTRATED FABRIC SOFTENING COMPOSITION

BACKGROUND OF INVENTION

The present invention relates to fabric softener compositions adapted for use in the rinse cycle of a laundering operation.

Liquid fabric softening compositions have been known in the art and are widely used by consumers during the wash and rinse cycles of automatic laundry operations. The term "fabric softening", as used herein and as known in the art, refers to a process whereby a desirably soft handle and fluffy appearance are imparted to the fabrics.

Compositions containing quaternary ammonium salts having at least one long chain hydrocarbyl group are commonly used to provide fabric softening benefits when utilized in laundry rinse operations. For example, see U.S. Pat. Nos. 3,349,033; 3,946,115; and 3,644,203.

For most liquid softener compositions containing cationics as active ingredients, the concentration of such cationics has been limited to the range of about 3 to 6% by weight (U.S. Pat. Nos. 3,904,533 and 3,920,565). This low concentration range of cationics is brought forth by the fact that cationics form gels at the concentrations above 8%. At concentrations above 8%, the electrolytes frequently used to lower the viscosity of fabric softeners, e.g., sodium chloride, sodium carbonate, and sodium acetate, are ineffective.

Despite the problem with gelling, efforts have been made to develop concentrated cationic fabric softeners. Smaller packages for the same amount of active ingredients, less bulky containers, and less storage space are reasons for the development of concentrated cationic-containing fabric softeners.

U.S. Pat. No. 3,920,565 discloses a liquid fabric softener containing a soap and cationic softening agents. The concentration of the cationic is from about 2 to 15% by weight. However, it is also noted in this patent that the preferred range is from 2.5 to 6%, in order to avoid gelling problems.

U.S. Pat. No. 3,954,634 discloses a process for forming a stable, low viscosity fabric softener containing 7 to 15% by weight of cationics. The process comprises pre-mixing deionized water and the softening agent, and homogenizing at a pressure of from 500 to 8000 psi. The use of anti-gelling agent is not disclosed in this patent.

U.S. Pat. No. 3,970,596 discloses a liquid detergent composition having an anti-gelling agent comprising a mixture of nitrate and chloride salts. However, the active detergent ingredient disclosed is alpha-olefin sulfonate which is anionic. Furthermore, test runs in this patent showed that, when the nitrate was used alone, gelling resulted.

U.S. Pat. No. 3,554,916 discloses a process of preventing the gelling of detergent compositions containing the product of an alkylaryl sulfonic acid neutralized with an amine by incorporating a small amount of a $C_4$ to $C_8$ alcohol. The use of $Al(NO_3)_3$ as an additive resulted in a pourable product. However, it is noted that the detersive compound used here is a neutralized product.

U.S. Pat. Nos. 3,959,155 and 3,958,059 are directed to anti-static compositions. The use of zinc nitrate is disclosed, but the nitrate does not function as an anti-gelling agent.

U.S. Pat. No. 3,953,380 discloses a liquid synthetic heavy-duty laundry detergent composition. An alcohol is used as an anti-gelling agent.

The above-cited references show that there is a need to develop a stable concentrated fabric softening composition which is economical to produce.

SUMMARY OF THE INVENTION

The present invention provides a stable concentrated fabric softening composition which comprises an anti-gelling agent, a cationic softening agent, and the remainder being substantially water.

The present invention provides a method by which a concentrated fabric softening composition is produced.

The present invention also provides a process whereby fabrics are rendered soft and fluffy by using a concentrated fabric softening composition.

DETAILED DESCRIPTION OF INVENTION

The composition of the present invention is directed to a stable liquid fabric softening composition containing a high concentration of a cationic fabric softener. The composition comprises from about 0.05 to 5.0% by weight of an anti-gelling agent, from about 8 to about 20% by weight of a cationic fabric softening agent, and the remainder being substantially water.

The composition has a viscosity at room temperature ranging from about 100 to about 1500 centipoises, preferably from about 200 to about 1000 centipoises.

The anti-gelling agent which is present in the composition from about 0.05 to about 5% by weight, preferably from about 0.1 to about 1.5% by weight, includes the nitrates or nitrites of alkali metals. Examples of useful anti-gelling agents include sodium nitrate, sodium nitrite, potassium nitrate and potassium nitrite, with sodium nitrate and sodium nitrite being preferred, and sodium nitrate most preferred.

The cationic fabric softener is present in the composition from about 8 to about 20% by weight, preferably from about 15 to about 19% by weight. Useful cationics include quaternary ammonium salts and imidazolinium salts.

Suitable fabric softeners are the cationic quaternary ammonium salts which have the general formula

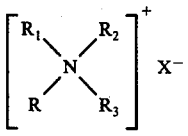

(1)

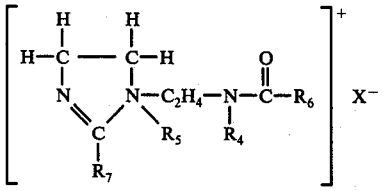

(2)

wherein $R_5$ is an alkyl containing from one to four, preferably from one to two, carbon atoms, $R_6$ is an alkyl containing from one to four carbon atoms or a hydrogen radical, $R_7$ is an alkyl containing from eight to 25, preferably at least 15, carbon atoms, $R_4$ is hydrogen or an alkyl containing from eight to 25, preferably at least 15, carbon atoms, and X is an anion, preferably methyl sulfate or chloride ions. Other suitable anions include those disclosed with reference to the cationic fabric softeners of formula (1). Particularly preferred are those compounds of formula (2) in which both $R_4$ and $R_7$ are alkyls of from 16 to 25, especially 16 to 18 and 20 to 22, carbon atoms. Particular examples of the imidazolinium compounds include 2-heptadecyl-1-methyl-1[(2-stearoylamido)ethyl]-imidazolinium methyl sulfate, 2-heptadecyl-1-methyl-1[(2-stearoylamido)ethyl]-imidazolinium chloride, 2-methyl-1-(2-hydroxyethyl)-1-benzyl imidazolinium chloride, 2-coco-1-(2-hydroxyethyl)-1-benzyl imidazolinium chloride, 2-coco-1-(hydroxyethyl)-1-(4-chlorobutyl)-imidazolinium chloride, 2-coco-1-(2-hydroxyethyl)-1-octadecenyl imidazolinium chloride, 2-tall oil fatty-1-(2-hydroxyethyl)-1-benzyl imidazolinium chloride, 2-tall oil fatty-1-(2-hydroxyethyl)-1-(4-chlorobutyl)-imidazolinium chloride, 2-heptadecenyl-1-(2-hydroxyethyl)-1-(4-chlorobutyl)-imidazolinium chloride, 2-heptadecenyl-1-(2-hydroxyethyl)-1-benzyl imidazolinium chloride, and 2-heptadecyl-1-(hydroxyethyl)-1-octadecyl imidazolinium ethyl sulfate.

Many other cationic quaternary ammonium fabric softeners which are useful herein are known, for example, alkyl [$C_{12}$ to $C_{20}$]-pyridinium chlorides, alkyl [$C_{12}$ to $C_{20}$]-alkyl [$C_1$ to $C_3$]-morpholinium chlorides, and quaternary derivatives of amino acids and amino esters.

Among the above-listed cationics, the preferred quaternary ammonium salt is dimethyl distearyl ammonium chloride and the preferred imidazolinium salts are 1-methyl-1-(alkyl-amido)-ethyl-2-alkyl-imidazolinium methyl sulfates.

In addition to the anti-gelling agent and cationic softener, the composition may include minor proportions of adjuvants. Examples of such minor adjuvants include perfume, coloring dyes, optical brighteners and bactericides. Furthermore, nonionic surface-active agents may be added as an adjuvant. The amount of each of the adjuvants should not exceed 1% by weight of the composition.

The method by which the composition of the present invention is formed is of significance. It has been found that the anti-gelling agent must be first dissolved in water and the cationic softener is then added to the resulting solution in order to obtain a softening composition which will not gel upon aging. On the other hand, if the cationic is first added to the water and the anti-gelling agent is then added, the resulting solution has a low initial viscosity (about 100 cp). However, as time elapses, the viscosity of the solution increases rapidly to form a compact gel.

The process of the present invention comprises adding a suitable amount of a concentrated fabric softening solution comprising from about 0.01 to about 5% by weight of an anti-gelling agent selected from the nitrates or nitrites of alkali metals, from about 8 to about 20% by weight of a cationic fabric softening agent, and the remainder being substantially water, to the water in the rinse cycle of a domestic washing machine.

The composition and process of the present invention will now be illustrated by way of the following examples, which are for illustration purposes and are not to be taken as limiting.

EXAMPLES 1-6

The fabric softening composition of this invention was prepared by first dissolving the anti-gelling agent in water and then adding the cationic fabric softener to the resulting solution. The formulations of the compositions and the results are summarized in Table I. The viscosities of the compositions were measured with a Brookfield RVT viscosimeter at a speed of 50 rpm with a No. 2 'spindle. The experiments were conducted at 25° C.

Table I

| | Wt% of Softening Agent* | Wt% of Anti-gelling Agent** | Anti-gelling Agent | Viscosity of Composition (CP) |
|---|---|---|---|---|
| Ex. 1 | 19 | 0.1 | $NaNO_3$ | 1,500 |
| Ex. 2 | 19 | 0.15 | $NaNO_3$ | 930 |
| Ex. 3 | 19 | 0.2 | $NaNO_3$ | 310 |
| Ex. 4 | 19 | 0.4 | $NaNO_3$ | 106 |
| Ex. 5 | 19 | 0.7 | sodium toluene sulfonate | 1,080 |
| Ex. 6 | 19 | 0 | — | gel |

*an imidazolinium salt (1-methyl-1-alkyl-amido-ethyl-2-alkyl-imidazolinium methyl sulfate)
**water to Q.S. 100%

Examples 7-9 were conducted to show the significance of the sequence of adding the ingredients.

EXAMPLE 7

A fabric softening composition having the following ingredients was formed by first adding the softening agent to the water and then adding the anti-gelling agent:

| | |
|---|---|
| Anti-gelling agent | 0.4% by weight |
| Cationic softening agent (an imidazolinium salt) | 19% by weight |
| Water | Q.S. to 100% by weight |

The resulting solution had an initial viscosity, i.e., the viscosity immediately after forming, of below 100 cp. However, as time elapsed, the viscosity increased rapidly to form a compact gel.

EXAMPLE 8

A fabric softening composition having the following formulation was formed by first dissolving the anti-gelling agent in water and then adding the cationic fabric softener to the solution:

| | |
|---|---|
| Anti-gelling agent | 0.2% by weight |
| Cationic softening agent (an imidazolinium salt) | 19% by weight |
| Water | Q.S. to 100% by weight |

The viscosity of the composition was measured by using the same apparatus and procedure used in Examples 1-6. The composition had an initial viscosity of 310 cp, which became 615 cp after storage at 35° C. for 6 weeks.

EXAMPLE 9

A fabric softening composition having the following formulation was prepared by using the procedure shown in Example 8:

| | |
|---|---|
| Anti-gelling agent | 0.4% by weight |
| Cationic softening agent (an imidazolinium salt) | 19% by weight |
| Water | Q.S. to 100% by weight |

The viscosity of the composition was measured by using the same apparatus and procedure used in Examples 1-6. The composition had an initial viscosity of 106 cp, which became 215 cp after storage at 35° C. for 6 weeks.

EXAMPLE 10

Examples 1–4 were repeated, with the exception that 15% by weight of dimethyl distearyl ammonium chloride was used in place of the imidazolinium salt and 0.5% by weight of sodium nitrate was used. In each instance, a pourable liquid composition which was easily dispersible in cold water was obtained.

What is claimed is:

1. A concentrated fabric softening composition comprising from about 0.01 to about 5% by weight of an antigelling agent selected from the group consisting of alkali metal nitrates and alkali metal nitrites, from about 8 to about 20% by weight of a cationic fabric softening agent, and the remainder being substantially water.

2. The composition of claim 1 wherein the anti-gelling agent is sodium nitrate and is present from about 0.1 to about 1.5% by weight.

3. The composition of claim 1 wherein the anti-gelling agent is sodium nitrate and is present from about 0.15 to about 1.5% by weight, from about 15 to about 19% by weight of a cationic fabric softener selected from the group consisting of quaternary ammonium and imidazolinium salts, and the remainder is substantially water.

4. The composition of claim 1 formed by first dissolving the anti-gelling agent in water and subsequently adding the cationic fabric softener to the solution.

5. The composition of claim 1 having a viscosity of from about 100 to about 1,500 centipoises.

6. The composition of claim 5 having a viscosity of from about 200 to about 1,000 centipoises.

7. A process of softening fabrics comprising adding to the water in the rinse cycle of a washing machine a concentrated fabric softening composition comprising from about 0.01 to about 5% by weight of an anti-gelling agent selected from the group consisting of alkali metal nitrates and alkali metal nitrites, from about 8 to about 20% by weight of a cationic softening agent, and the remainder being substantially water.

8. A method for preparing the composition of claim 1 which will not gel upon aging, comprising dissolving the anti-gelling agent in water and adding the cationic softner to said anti-gelling agent solution.

* * * * *